US007791486B2

(12) United States Patent
Ho

(10) Patent No.: US 7,791,486 B2
(45) Date of Patent: Sep. 7, 2010

(54) MAGNETIC DETACHER WITH OPEN ACCESS

(75) Inventor: Wing K. Ho, Boynton Beach, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 96 days.

(21) Appl. No.: 12/151,894

(22) Filed: May 10, 2008

(65) Prior Publication Data

US 2008/0246574 A1 Oct. 9, 2008

Related U.S. Application Data

(62) Division of application No. 11/292,581, filed on Dec. 1, 2005, now Pat. No. 7,391,327.

(51) Int. Cl.
*G08B 13/14* (2006.01)

(52) U.S. Cl. ..... 340/572.3; 335/306; 335/284

(58) Field of Classification Search ..... 340/572.3, 340/572.9; 335/306, 284, 285–296, 302
See application file for complete search history.

(56) References Cited

U.S. PATENT DOCUMENTS

| | | | | |
|---|---|---|---|---|
| 4,339,853 | A * | 7/1982 | Lipschitz | 70/57.1 |
| 5,942,978 | A * | 8/1999 | Shafer | 340/572.9 |
| 6,084,498 | A * | 7/2000 | Stelter et al. | 335/306 |
| 6,774,794 | B2 * | 8/2004 | Zimmerman et al. | 340/572.8 |
| 7,148,805 | B2 * | 12/2006 | Hogan | 340/572.9 |
| 2006/0170559 | A1 * | 8/2006 | Marsilio et al. | 340/572.9 |
| 2007/0096925 | A1 * | 5/2007 | Yang et al. | 340/572.9 |

* cited by examiner

*Primary Examiner*—Davetta W Goins
*Assistant Examiner*—Edny Labbees

(57) ABSTRACT

Various embodiments of a magnetic detacher with open access are described. In one embodiment, the magnetic detacher may include magnet assembly to provide open access to a hard tag and a magnetic field sufficient to disengage a clamping mechanism of the hard tag. Other embodiments are described and claimed.

20 Claims, 4 Drawing Sheets

MAGNETIC DETACHER WITH OPEN ACCESS

CROSS-REFERENCE TO RELATED APPLICATIONS

This application is a divisional of U.S. patent application Ser. No. 11/292,581, filed Dec. 1, 2005 entitled MAGNETIC DETACHER WITH OPEN ACCESS, the entire disclosure of which is hereby expressly incorporated by reference.

BACKGROUND

An Electronic Article Surveillance (EAS) system is designed to prevent unauthorized removal of an item from a controlled area. A typical EAS system may comprise a monitoring system and one or more security tags. The monitoring system may create an interrogation zone at an access point for the controlled area. A security tag may be fastened to an item, such as an article of clothing. If the tagged item enters the interrogation zone, an alarm may be triggered indicating unauthorized removal of the tagged item from the controlled area. In general, the security tag must be deactivated before a tagged item can leave the controlled area without triggering the alarm.

Security tags may take a variety of forms including soft tags and hard tags. In general, soft tags are disposable and used only once, while hard tags are reusable. An example of a soft tag is an adhesive-backed security label. A soft tag may be deactivated by a deactivator unit, such as a scanner that uses a specific field to deactivate the soft tag when it touches or comes in close proximity to the soft tag.

Hard tags typically comprise a plastic tag body housing an EAS sensor and a locking mechanism including a pin or tack which passes through the item and is clamped to the tag body to secure the item and tag together. In general, a hard tag requires a detacher unit to remove the tack from the tag body and allow the item to be separated from the hard tag. In some applications, a detacher unit may include a magnet assembly which applies a magnetic field to the tag body for releasing the tack.

FIG. 1 illustrates a conventional hard tag 10 having a plastic tag body 11 formed with a protrusion 12. The tag body 11 houses an EAS sensor 13 for triggering an alarm. The hard tag 10 includes a tack 14 with an enlarged head 15. As shown, the tack 14 is securely held by a clamping mechanism 16 within the tag body 11.

FIG. 2 illustrates a conventional magnet assembly 20 for a detacher unit. The magnet assembly 20 includes a cylindrical magnet 21 and an oppositely magnetized ring magnet 22 stacked on top of the cylindrical magnet 21. As shown, the magnet assembly 20 includes a cavity 23 of approximately 6 to 7 mm in depth. This configuration is well-suited for a conventional hard tag, such as hard tag 10, where the cavity 23 of the magnet assembly 20 is compatible with the protrusion 12 of the tag body 11. To permit the removal of the tack 14, the protrusion 12 is inserted into the cavity 23 to take advantage of the strong field inside the ring magnet 22. The magnet assembly 20 provides a substantially vertical magnetic field in the cavity 23 sufficient to force the clamping mechanism 16 to disengage and allow removal of the tack 14 from the tag body 11.

In many tagging applications, such as tagging of bottles and compact discs, for example, the clamping mechanism of a hard tag may be embedded in the existing packaging of an item or may have a low profile to minimize vulnerability of defeats and facilitate shelving of items. For such applications and packaging requirements, a different detacher design is required to provide open access to the embedded or low profile clamping mechanism and, at the same time, providing a sufficient magnetic field.

DETAILED DESCRIPTION

Numerous specific details may be set forth herein to provide a thorough understanding of the embodiments of the invention. It will be understood by those skilled in the art, however, that the embodiments of the invention may be practiced without these specific details. In other instances, well-known methods, procedures, components and circuits have not been described in detail so as not to obscure the embodiments of the invention. It can be appreciated that the specific structural and functional details disclosed herein may be representative and do not necessarily limit the scope of the invention.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
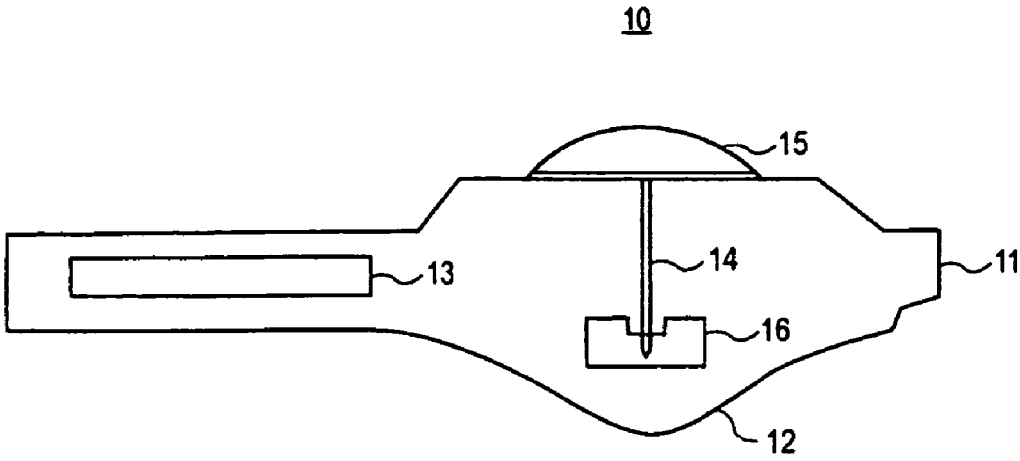
FIG. 1 (PRIOR ART)
FIG. 1 illustrates a conventional hard tag.
Figure 2:
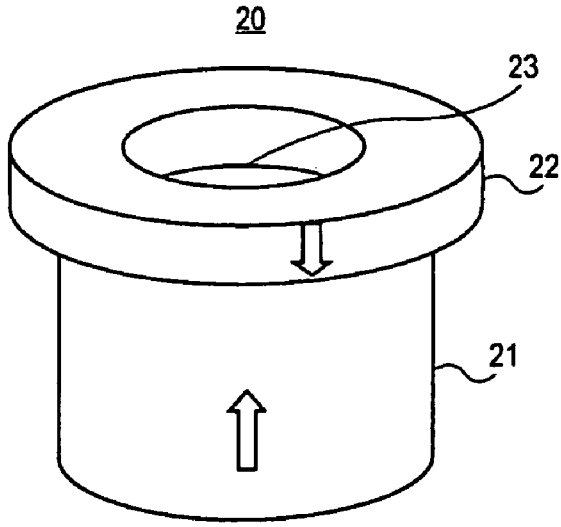
FIG. 2 (PRIOR ART)
FIG. 2 illustrates a conventional magnet assembly for a detacher unit.
Figure 3:
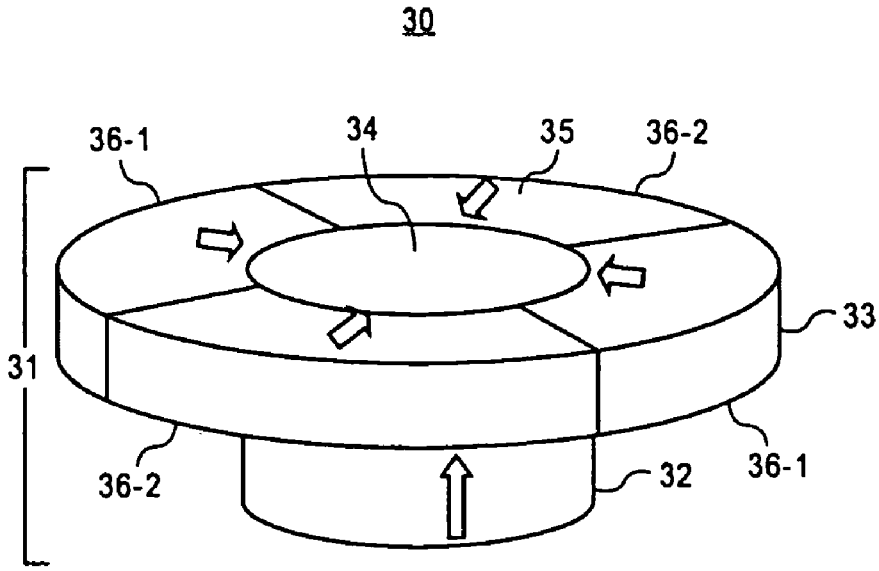
FIG. 3 illustrates a magnetic detacher in accordance with one embodiment.

FIG. 3 illustrates one embodiment of a magnetic detacher 30. In this embodiment, the magnetic detacher 30 comprises a magnet assembly 31 including a cylindrical magnet 32 and a ring magnet 33. In various implementations, the cylindrical magnet 32 and the ring magnet 33 may comprise one or more permanent magnets. In general, permanent magnets have a defined magnetization axis dependent upon the magnetization process, orientation of the material, the geometry, and other material properties.

In various embodiments, the permanent magnets may comprise paramagnetic components such as samarium (Sm) and neodymium (Nd) and ferromagnetic components such as iron (Fe) and cobalt (Co). During the fabrication of permanent magnets, a crystalline domain structure may be created which exhibits oriented intra-domain magnetization known as magneto-crystalline anisotropy, which is the mechanism that produces strong magnetic fields. The permanent magnet may undergo processing including, for example, compression of components in the presence of an ambient magnetic field, sintering of the compressed material, and remagnetization.

Examples of permanent magnets include but are not limited Neodymium Iron Boron (NdFeB) magnets, hard ferrite magnets, and cobalt magnets such as Samarium Cobalt (SmCo) magnets and Aluminum Nickel Cobalt (AlNiCo) magnets. The permanent magnets may comprise sintered and/ or bonded magnets. The permanent magnets also may include a variety of coatings to deter corrosion.

In various embodiments, the magnetic detacher 30 is structured and arranged to provide open access to various magnetic clamping mechanisms. As such, the magnetic detacher 30 is capable of disengaging the clamping mechanism of a hard tag placed at any angular position relative to its axis. In various implementations, the magnetic detacher 30 is configured to provide a relatively symmetric field about its axis making it usable for hard tag placed at any angular position.

In the embodiment shown in FIG. 3, for example, a top surface 34 of the cylindrical magnet 32 is substantially coplanar and concentric with a top surface 35 of the ring magnet 33. As shown, the cylindrical magnet 32 and the ring magnet 33 are substantially flush allowing a hard tag to be received in any direction. The magnetic detacher 30 thus provides open access to various magnetic clamping devices in hard tags. The embodiments are not limited in this context.

In some embodiments, the top surface 34 of the cylindrical magnet 32 may be slightly offset upwardly or downwardly from the top surface 35 of the ring magnet 33. For example, the top surface 34 of the cylindrical magnet 32 may offset by 2 to 3 mm higher or lower from the top surface 35 of the ring magnet 33. The embodiments are not limited in this context.

In various embodiments, the magnet assembly 31 comprises a ring magnet 33 that is magnetized radially. The ring magnet 33 may comprise, for example, multiple sections **36-1-*n*, where n represents a positive integer value and each of the multiple sections 36-1-*n* is magnetized in a direction pointing to the center of the ring magnet 33. In the embodiment shown in FIG. 3, for example, the ring magnet 33 is quartered into a first section 36-1, second section 36-2, third section 36-3, and fourth section 36-4. In FIG. 3, the white arrows indicate the orientation of magnetization. In this embodiment, for the top half of the ring magnet 33, magnetic flux is directed inwardly toward the center of the ring magnet 33 and bent upwardly and out of the ring magnet 33. The magnetic field of the ring magnet 33 adds to the upwardly pointing magnetic field generated by the core cylindrical magnet 32** resulting in a very strong magnetic field.

In some embodiments, the orientation of magnetization shown in FIG. 3 may be reversed. For example, the core cylindrical magnet 32 may generate a downwardly pointing magnetic field, and the ring magnet 33 may direct magnetic flux outwardly from the center of the ring magnet 33.

In various implementations, the magnet assembly 31 provides a relatively symmetric field about its axis making the magnetic detacher 30 usable for a hard tag placed at any angular position. In some embodiments, soft iron material can be placed at the bottom of the magnet assembly 31 to achieve keeper effect and enhance the surface field.

In various embodiments, the ring magnet 33 may be divided into four or more sections with each magnet section magnetized in a direction pointing to the center of the ring magnet 33. It can be appreciated that with less than four sections, the ring magnet 33 may have substantial field variation so that the clamping mechanism can only be disengaged at specific angular positions.

Figure 4:
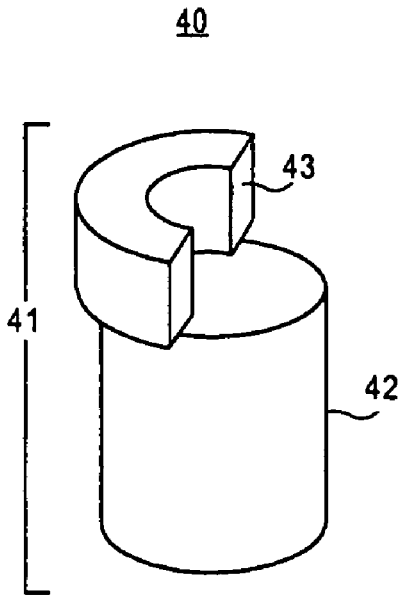
FIG. 4 illustrates a magnetic detacher in accordance with one embodiment.

FIG. 4 illustrates one embodiment of a magnetic detacher 40. In this embodiment, the magnetic detacher 40 comprises a magnet assembly 41 including a cylindrical magnet 42 and a half-ring magnet 43. In various implementations, the cylindrical magnet 42 and the half-ring magnet 43 may comprise one or more permanent magnets.

In various embodiments, the magnetic detacher 40 is structured and arranged to provide open access to various magnetic clamping mechanisms from one side of the magnet assembly 41. As such, the magnetic detacher 40 is capable of disengaging the clamping mechanism of a hard tag placed at various angular positions relative to one side of the magnet assembly 41. In general, the height of the half-ring magnet 43 (e.g., 12 mm) will be greater than the height of the ring magnet 22 (e.g., 7 mm) of the conventional magnet assembly 20 to provide a sufficient magnetic field to disengage various clamping mechanism of hard tags while providing open access to one side of the magnet assembly 41. The embodiments are not limited in this context.

Figure 5:
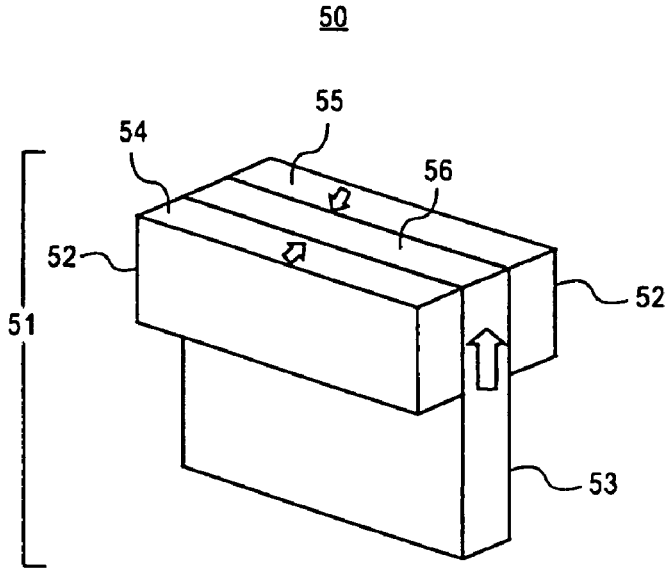
FIG. 5 illustrates a magnetic detacher in accordance with one embodiment.

FIG. 5 illustrates one embodiment of a magnetic detacher 50. In this embodiment, the magnetic detacher 50 comprises a magnet assembly 51 including a first rectangular magnet 52, a second rectangular magnet 53, and a third rectangular magnet 54. In various implementations, the first rectangular magnet 52, the second rectangular magnet 53, and the third rectangular magnet 54 may comprise one or more permanent magnets. In some embodiments, the magnetic detacher 50 may comprise one or more additional rectangular magnets.

In various embodiments, the magnetic detacher 50 is structured and arranged to provide open access to various magnetic clamping mechanisms. In the embodiment shown in FIG. 5, for example, a top surface 55 of the first rectangular magnet 52, a top surface 56 of the second rectangular magnet 53, and a top surface 57 of the third rectangular magnet 54 are substantially coplanar. As shown, the first rectangular magnet 52, the second rectangular magnet 53, and the third rectangular magnet 54 are substantially flush allowing a hard tag to be received in any direction. The magnetic detacher 50 thus provides open access to various magnetic clamping devices in hard tags. It can be appreciated that magnets with rectangular geometry, due to the lack of symmetry, tend to generate a weaker magnetic field than magnets with round geometry and do not have azimuthal symmetry. The embodiments are not limited in this context.

TABLE 1 illustrates a comparison of magnetic surface fields in kilo-Gauss (kG) at the center on a cylindrical magnet for various magnet detacher configurations. The configurations may include a ring magnet having an inner diameter (ID), an outer diameter (OD), and height (h).

TABLE 1

| Magnetic Detacher Configuration | Ring Magnet Dimensions (mm) | Ring Magnet Volume (cc) | Surface Field (kG) |
|---|---|---|---|
| 1. Cylindrical magnet only | NA | 0 cc | 5.424 kG |
| 2. Ring magnet on cylindrical magnet | ID = 15, OD = 30, h = 7 | 3.68 cc | 7.068 kG |
| 3. Ring magnet flush with cylindrical magnet | ID = 24, OD = 44, h = 10 | 10.68 cc | 6.426 kG |
| 4. Ring magnet flush with cylindrical magnet | ID = 24, OD = 44, h = 12 | 12.82 cc | 7.115 kG |
| 5. Ring magnet flush with cylindrical magnet | ID = 24, OD = 59, h = 10 | 22.82 cc | 7.071 kG |
| 6. Half ring magnet on cylindrical magnet | ID = 15, OD = 30, h = 12 | 3.180 cc | 6.161 kG |

As shown in TABLE 1, the detacher configuration using only a single cylindrical magnet provides a much lower surface field than the detacher configurations using a magnet assembly. To achieve open access with a single magnet configuration would require employing only a cylindrical magnet, for example, by removing the ring magnet 22 from the conventional magnet assembly 20. Such approach compromises the detaching field as the clamping mechanism must be designed to be opened by a weaker magnet and thus made more susceptible to defeat by a "street" magnet.

As also shown in TABLE 1, a similar field to that provided by the conventional detacher configuration using a ring magnet on a cylindrical magnet can be achieved with the appropriate choice of dimensions for a ring magnet that can fit over a cylindrical magnet. As such, the detacher configurations using a ring magnet flush with a cylindrical magnet provide open access and a sufficient field with the appropriate choice of magnet dimensions. For example, the height of the ring magnet (e.g., ring magnet 33) can be increased to 12 mm, or alternately, the outer diameter can be increased to about 60 mm to achieve a magnetic field level of about 7.1 kG for such detacher configurations. In addition, the detacher configuration using a half ring magnet having a height of about 12 mm stacked on a cylindrical magnet also may provide a sufficient magnetic field while allowing open access from one side of the magnet assembly. The embodiments are not limited in this context.

Figure 6:
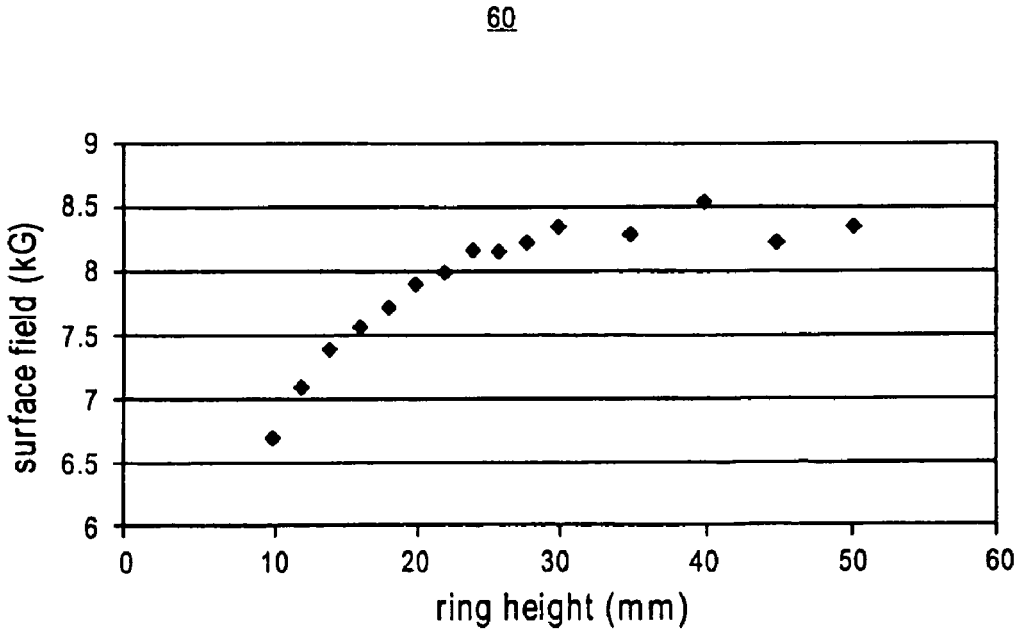
FIG. 6 illustrates a graph in accordance with one embodiment.

FIG. 6 illustrates one embodiment of a graph 60 illustrating magnetic field level as a function of ring magnet height for various magnetic detacher configurations using a ring magnet flush with a cylindrical magnet. As shown, further field enhancement is possible with a larger magnet. The embodiments are not limited in this context.

Figure 7:
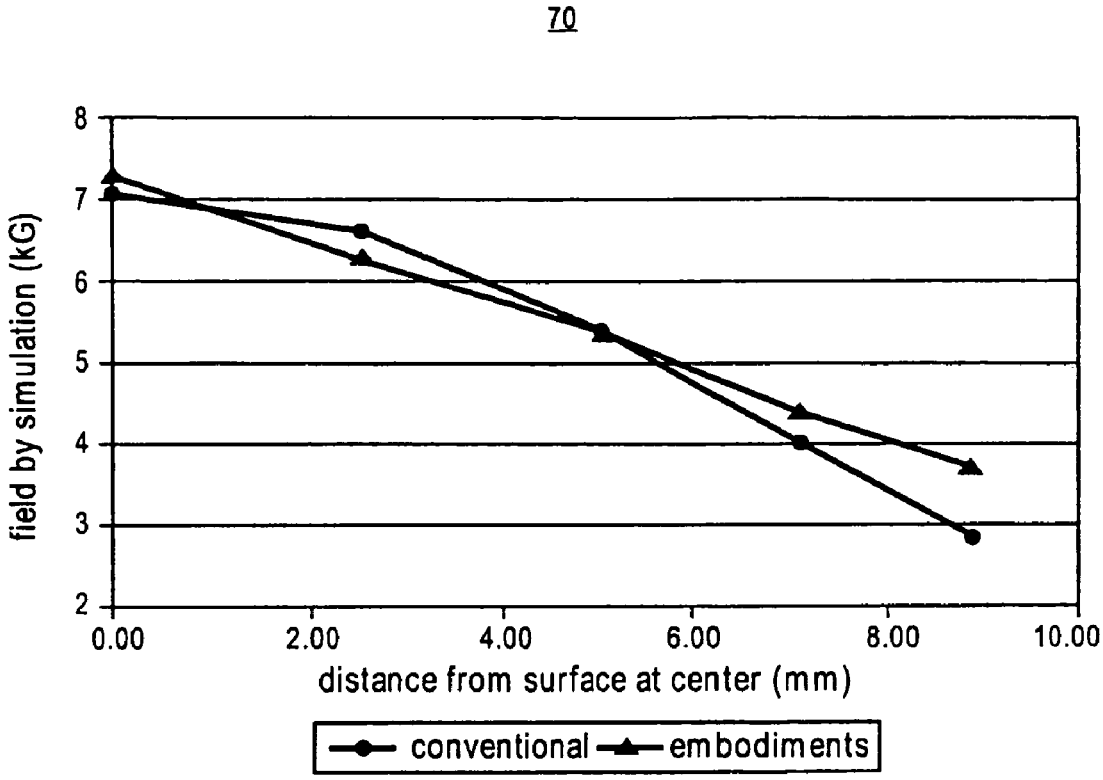
FIG. 7 illustrates a graph in accordance with one embodiment.

FIG. 7 illustrates one embodiment of a graph 70 illustrating magnetic field level as a function of distance from the center of the magnet surface. As shown in the plot, various embodiments of the magnetic detacher have enhanced field projection as compared to the conventional magnet assembly. In such embodiments, the magnetic detachers have a longer field projection allowing the magnetic detachers to disengage the clamping mechanism of a hard tag at greater distances as compared to the conventional magnet assembly. The embodiments are not limited in this context.

The discussion and field values above are based on using grade 35 NdFeB magnets. If a higher grade of magnet such as a grade 50 NdFeB magnet is used, the magnetic field levels typically will increase by 10-15%. The embodiments are not limited in this context.

In various implementations, the described embodiments comprise a magnetic detacher to provide open access to various hard tags and a sufficiently strong magnetic field level for disengaging the clamping mechanism of such hard tags. The described embodiments may be employed in a variety of tagging applications, such as tagging of bottles and compact discs, for example, where the clamping mechanism of a hard tag is embedded in the existing packaging of an item or may have a low profile to minimize vulnerability of defeats and facilitate shelving of items.

In various implementations, the described embodiments avoid the need to use a high profile or protruding design in tagging applications such as tagging bottles and compact discs. The use of a protruding clamp on a slender package such as that of a compact disc, jewel case, or eyeglass wear is often problematic since the protruding clamp is prone to being snapped off or other tampering. The use of a protruding clamp also hinders efficient use of shelf space since the protrusion consumes space and makes stacking or arranging merchandise difficult.

In various implementations, the described embodiments comprise a magnetic detacher using a magnet assembly that provides a higher magnetic field level than a detacher configuration using only a single magnet. Such embodiments avoid the need to design the clamping mechanism of a hard tag to work with a weaker magnet which would lower defeat resistance.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

The invention claimed is:

1. A magnetic detacher, comprising:

a magnet assembly to provide open access from one side of said magnet assembly to a hard tag comprising a clamping mechanism and to provide a magnetic field sufficient to disengage the clamping mechanism of the hard tag when the hard tag is placed at various angular positions relative to one side of the magnet assembly, said magnet assembly comprising:

a cylindrical magnet; and a half-ring magnet stacked on said cylindrical magnet in a concentric arrangement.

2. The magnetic detacher of claim 1, wherein said magnet assembly comprises one or more permanent magnets.

3. The magnetic detacher of claim 2, wherein said one or more permanent magnets comprises at least one of a NdFeB magnet, a hard ferrite magnet, a SmCo magnet, and an AlNiCo magnet.

4. The magnetic detacher of claim 1, wherein said half ring magnet comprises a height dimension greater than or equal to 12 mm.

5. A magnetic detacher, comprising:

a magnet assembly to provide open access to a hard tag comprising a clamping mechanism and to provide a magnetic field sufficient to disengage said clamping mechanism of said hard tag, said magnet assembly comprising:

a ring magnet; and a cylindrical magnet bonded to said ring magnet and inside and forming a core said ring magnet, said cylindrical magnet and said ring magnet being mounted in a concentric arrangement wherein said cylindrical magnet has a top surface slightly offset with a top surface of said ring magnet.

6. The magnetic detacher of claim 5, wherein said top surface of said cylindrical magnet is offset less than 3 mm lower than said top surface of said ring magnet.

7. The magnetic detacher of claim 5, wherein said top surface of said ring magnet is offset higher than said top surface of said cylindrical magnet.

8. The magnetic detacher of claim 5, wherein said ring magnet is radially magnetized.

9. The magnetic detacher of claim 5, wherein said ring magnet comprises multiple sections.

10. The magnetic detacher of claim 9, wherein each of said multiple sections is magnetized in a direction pointing to a center of said ring magnet.

11. The magnetic detacher of claim 9, comprising four or more sections.

12. The magnetic detacher of claim 5, wherein magnet flux generated by said ring magnet is directed inwardly toward a center of said ring magnet and bent upwardly and out of said ring magnet.

13. The magnetic detacher of claim 5, wherein a magnetic field generated by said ring magnet adds to a vertically pointing magnetic field generated by said cylindrical magnet.

14. The magnetic detacher of claim 5, wherein said magnet assembly provides a relatively symmetric radial field about an axis of the magnet assembly.

15. The magnetic detacher of claim 5, further comprising soft iron material placed at a bottom of said magnet assembly to enhance the magnetic field.

16. The magnetic detacher of claim 5, wherein said magnet assembly comprises one or more permanent magnets.

17. The magnetic detacher of claim 16, wherein said one or more permanent magnets comprises at least one of a NdFeB magnet, a hard ferrite magnet, a SmCo magnet, and an AlNiCo magnet.

18. The magnetic detacher of claim 5, wherein said ring magnet comprises a height dimension greater than or equal to 10 mm.

19. The magnetic detacher of claim 5, wherein said ring magnet comprises an outer diameter dimension greater than or equal to 44 mm.

20. The magnetic detacher of claim 5, wherein said magnet assembly provides enhanced field projection.

* * * * *